US008442250B2

(12) United States Patent
Klinkby

(10) Patent No.: US 8,442,250 B2
(45) Date of Patent: May 14, 2013

(54) HEARING AID AND METHOD FOR CONTROLLING SIGNAL PROCESSING IN A HEARING AID

(75) Inventor: Kristian Tjalfe Klinkby, Varlose (DK)

(73) Assignee: Widex A/S, Lynge (DK)

( * ) Notice: Subject to any disclaimer, the term of this patent is extended or adjusted under 35 U.S.C. 154(b) by 1265 days.

(21) Appl. No.: 12/238,739

(22) Filed: Sep. 26, 2008

(65) Prior Publication Data

US 2009/0028367 A1 Jan. 29, 2009

Related U.S. Application Data

(63) Continuation-in-part of application No. PCT/EP2007/053188, filed on Apr. 2, 2007.

(30) Foreign Application Priority Data

Apr. 1, 2006 (DK) ..... 2006 00466
Apr. 3, 2006 (DK) ..... 2006 00479

(51) Int. Cl.
*H04R 25/00* (2006.01)

(52) U.S. Cl.
USPC ..... 381/317; 381/312; 381/318

(58) Field of Classification Search ..... 381/23.1, 381/312–331
See application file for complete search history.

(56) References Cited

U.S. PATENT DOCUMENTS 6,741,714 B2 * 5/2004 Jensen ..... 381/313

FOREIGN PATENT DOCUMENTS

| | | |
|---|---|---|
| EP | 0414677 A2 | 3/1991 |
| WO | 0106746 A2 | 1/2001 |
| WO | 0106812 A1 | 1/2001 |
| WO | 0110170 A2 | 2/2001 |
| WO | 0122775 A2 | 3/2001 |

OTHER PUBLICATIONS

S. Haykin, Adaptive Theory, 3rd Edition, Prentice-Hall, NJ, USA 1996.

* cited by examiner

*Primary Examiner* — Duc Nguyen
*Assistant Examiner* — Matthew Eason
(74) *Attorney, Agent, or Firm* — Sughrue Mion, PLLC

(57) ABSTRACT

A hearing aid includes a signal path for receiving at least one audio input signal and an autocorrelation index (ACI) estimator (4). The ACI includes a down-sampler for producing a sampling-rate reduced signal of the audio input signal, a sign extractor for extracting a sign signal of the sampling rate reduced signal, a memory and delay for producing and storing delayed versions of the sign signal, a comparator for comparing a subset of the delayed versions of the sign signal with a version of the non-delayed audio input signal, and an averager for averaging the outputs of the comparator to extract delay specific estimates of the audio signal self-resemblance. An autocorrelation estimator obtains an estimated autocorrelation index by determining summarized features from the delay specific estimates of the audio signal self-resemblance. Also disclosed is a method and a computer program for controlling signal processing in a hearing aid.

20 Claims, 4 Drawing Sheets

$$= \quad y = \begin{cases} 1.0, \text{ if } x \geq 0 \\ -1.0, \text{ if } x < 0 \end{cases}$$

$$= \quad c = \begin{cases} a, \text{ if } b = 1.0 \\ -a, \text{ if } b = -1.0 \end{cases}$$

= Delay x by D samples.

= Reduce the sampling rate by the factor N.
i.e. skip to every N'th sample.

$$= \quad d = \begin{cases} c - \Delta, \text{ if } a >= b \\ c + \Delta, \text{ if } a < b \end{cases}$$

HEARING AID AND METHOD FOR CONTROLLING SIGNAL PROCESSING IN A HEARING AID

RELATED APPLICATIONS

The present application is a continuation-in-part of application no. PCT/EP2007053188 filed on Apr. 2, 2007 and published as WO-A1-2007113283, the contents of which are incorporated herein by reference. The present application is based on and claims priority from PA 2006 00466, filed on Apr. 1, 2006, in Denmark, the contents of which are incorporated herein by reference. Further the present application is based on and claims priority from PA 2006 00479, filed on Apr. 3, 2006, in Denmark, the contents of which are incorporated herein by reference.

BACKGROUND OF THE INVENTION

1. Field of the Invention

The present invention generally relates to hearing aids. The invention, more specifically, relates to a method for controlling the signal processing in a hearing aid and a hearing aid implementing such a method. More particularly, the present invention relates to a method for estimation of the autocorrelation index (ACI) which is utilized for control of the signal processing in a hearing aid.

2. Description of the Related Art

It is known in the prior art that a measure of signal autocorrelation may be useful in controlling signal processing of a hearing aid. In particular, features related to the autocorrelation index have been suggested to control adaptation rate of a feedback compensation system like a feedback cancellation filter in a hearing aid. It is also known that the calculation of such a measure can be quite costly in terms of memory demand and computational load. The ACI has also been suggested as input to other systems of a hearing aid such as an Auditory Scene Analysis (ASA) system. The ASA system provides a classification of the sound or noise environment of the hearing aid, partly based on the ACI, and helps the hearing aid's gain related systems to select an appropriate gain strategy. More generalized, the ACI helps the subsequent systems in the hearing aid to reach an appropriate strategy of functionality. Such systems could be a feedback cancellation system as mentioned above, an automatic loop gain estimator, an adaptive directional system (multi microphone system), a signal compression system (calculation of appropriate gain), a frequency modification system, etc. Thus, a good estimate of ACI could generally enhance the operation of a hearing aid.

The classical approach to illustrate ACI related features is to calculate a value of the signals self-resemblance by the autocorrelation function $r_{xx}$ as follows:

$$r_{xx}(\tau) = \lim_{T\to\infty} \frac{1}{T}\int_{-T/2}^{T/2} x(t)\cdot x(t-\tau)\,dt \tag{1}$$

in which t indicates the time and τ indicates the time lag or delay of the signal. In a discrete time domain, the equation above turns into a sum:

$$r_{xx}(j) = \frac{1}{N}\sum_{n=0}^{N-1} x(n)\cdot x(n-j) \tag{2}$$

in which n indicates the sample number or time stamp and j indicates the sample lag. Normalizing this index with $r_{xx}(0)$ creates an index $\rho_{xx}(n)$ with a ±1 range, in which +1 indicates exact self likeness and −1 indicates exact opposite waveform:

$$\rho_{xx}(j) = \frac{\sum_{n=0}^{N-1} x(n)\cdot x(n-j)}{\sum_{n=0}^{N-1} x(n)^2} \tag{3}$$

It is well known within the art, that the autocorrelation function for a sinusoidal waveform is a cosine, and that white noise (a stationary stochastic process) generates a Dirac delta function as shown in the following equation:

$$\begin{aligned} &x(n) = A\cdot\sin(\omega n/f_s+\phi) \Rightarrow r_{xx}(j) \to A^2\cdot\cos(\omega j)\,|\\ &\qquad N\to\infty \Rightarrow \rho_{xx}(j)\to\cos(\omega j)\,|\,N\to\infty \\ &x(n) = \sigma_x\cdot s(n) \Rightarrow \\ &\qquad r_{xx}(n)\to\sigma_x^2 \quad |\,n=0;\,N\to\infty \Rightarrow \rho_{xx}(n)=1 \qquad |\,n=0 \\ &\qquad r_{xx}(n)\to 0 \quad |\,n\neq 0;\,N\to\infty \quad \rho_{xx}(n)\to 0 \quad |\,n\neq 0;\,N\to\infty \end{aligned} \tag{4}$$

where s(n) is a unit variance stochastic sequence.

In the context of adaptive feedback cancellation systems, one could use an analysis of this function to control the adaptation rate of the adaptive filter. Thus, if $|\rho_{xx}(j)|$ or $|r_{xx}(j)|$ is large enough ($j\neq 0$), it could indicate a tonal microphone input such as feedback howling or an extraneous whistle. The adaptation rate controller could subsequently, in theory that is, apply its control strategy based on this fact in combination with other features. However, the numerous samples needed to be stored and the numerous multiplications required in the calculation make this approach unmanageable in most practical hearing aids.

For example, in the book: Haykin, S.: *Adaptive Filter Theory,* 3 rd Edition, Prentice-Hall, N.J., USA, 1996, it is suggested to use the condition number of an auto correlation matrix as an index of signal self-resemblance. This technique is also suggested in patent application EP-A-1 228 665, however, the approach is quite cumbersome and thus out of reach in modern hearing aids for the time being. Furthermore, the technique does not pinpoint the needs of subsequent systems in a hearing aid as mentioned above.

Another approach suggested in patent application EP-A-1 228 665 is to compare the sound pressure levels at two different frequencies, i.e. to compare the minimum and maximum energy output of a filter bank. Also this technique has its shortcomings, as it tells little about the amount of self-resemblance within a given frequency band.

Another technique is disclosed in patent application WO-A2-01/06746 according to which the signal bandwidth is estimated by means of a second order linear predictor.

Extracting the coefficients from the linear predictor indicates to which extent a sound can be thought of as being sinusoidal and at which frequency. In WO-A2-01/06746, the bandwidth detection is fed into a system for determining the adaptation rate of a feedback cancellation system. The bandwidth detection technique described therein fails, however, in delivering a robust measure of self-resemblance when more than one sinusoid is present in the signal.

Yet another prior art technique suggests to count the signal's zero crossing rate. It is a practical and simple approach, but it is also without the sufficient accuracy for a wide range of applications in modern hearing aids.

As previously described, existing solutions do not provide ACI estimation at reasonable memory and computation costs. Furthermore, the known solutions do not provide ACI estimation features meeting the requirements of today's hearing aids sub-systems.

Therefore, there still exists a need for improvements in this area. In particular, there exists a need for hearing aids in which methods for controlling signal processing based on improved ACI estimation have been implemented.

SUMMARY OF THE INVENTION

On the background described herein, it is an object of the present invention to provide a method and a hearing aid of the kind defined, in which the deficiencies of the prior art methods and hearing aids are remedied.

Particularly, it is an object of some embodiments of the present invention to provide a method and a hearing aid allowing to calculate ACI features suitable for control of the signal processing in a hearing aid in an efficient and resource saving manner.

More particularly, it is an object of some embodiments of the present invention to provide a method and a hearing aid allowing to provide relevant features about a signal's self-resemblance with feasible demands to memory and computational load in a hearing aid context. These features are then passed on to subsequent systems for further analysis, inference and control decisions in the hearing aid.

The present invention, in a first aspect, provides a hearing aid, comprising: a signal path for receiving at least one wideband audio input signal; autocorrelation index (ACI) estimating means, comprising down-sampling means for producing a sampling-rate reduced signal of said audio input signal; sign extraction means for extracting a sign signal of said sampling-rate reduced signal; memory and delay means for producing and storing delayed versions of said sign signal; comparison means for producing a subset of the delayed versions of said sign signal and comparing said subset with a version of the audio input signal; averaging means for averaging outputs of the comparison means to extract delay specific estimates of the signals self-resemblance of the delayed versions of said sign signal and the audio input signal; and autocorrelation index estimating means for obtaining an estimated autocorrelation index by determining summarized features from the delay specific estimates of the signals self-resemblance of said signals, wherein said summarized features define summarized informative ACI features.

This arrangement allows a computational effective ACI calculation by extracting only the sign signal of the sampling rate reduced signal since the multiplications in calculating the correlation function for the ACI are reduced to sign operations, which reduces the computational load on the processing unit of the hearing aid significantly. Moreover, storing the down-sampled versions of the sign signal instead of storing the full dynamics of the audio signal further reduces the memory demand of the hearing aid system.

The invention, in a second aspect, provides a method for controlling signal processing in a hearing aid comprising receiving at least one wideband audio input signal; estimating an autocorrelation index for said audio input signal, comprising: generating a sampling-rate reduced signal of the audio input signal; extracting a sign signal of said sampling rate reduced signal; generating and storing delayed versions of said sign signal; producing a subset of the delayed versions of said sign signal comparing said subset with a version of the audio input signal; averaging outputs of the comparing step to extract delay specific estimates of the signals self-resemblance of the delayed versions of said sign signal and the audio input signal; and deriving a version of the estimated autocorrelation index by determining summarized features from the delay specific estimates of the signals self-resemblance of said signals, wherein said summarized features define summarized informative ACI features.

According to the object of providing relevant features for the signal processing in a hearing aid, i.e. optimizing how informative the features are, there is provided a hearing aid and a method according to which the calculated ACI is divided into a number of band limited versions and a wide band version. In this way, a more detailed image of a signal's self-resemblance can be obtained as the frequency bands responsible for a given self-similarity can be directly observed and compared. This is achieved by a hearing aid receiving a wideband audio input signal and further comprising a bandpass filter bank for splitting the wideband audio input signal into band limited audio signals; and wherein the autocorrelation index estimating means is adapted for estimating at least one autocorrelation index by calculating an autocorrelation matrix for said band limited audio signals and an autocorrelation vector for said wideband audio input signal.

The invention, in a third aspect, provides a computer program product comprising program code for performing, when run on a computer, a method for controlling signal processing in a hearing aid comprising: receiving at least one wideband audio input signal; estimating an autocorrelation index for said audio input signal, comprising generating a sampling-rate reduced signal of the audio input signal; extracting a sign signal of said sampling rate reduced signal; generating and storing delayed versions of said sign signal; producing a subset of the delayed versions of said sign signal comparing said suhset with a version of the audio input signal; averaging outputs of the comparing step to extract delay specific estimates of the signals self-resemblance of the delayed versions of said sign signal and the audio input signal; and deriving a version of the estimated autocorrelation index by determining summarized features from the delay specific estimates of the signals self-resemblance of said signals, wherein said summarized features define summarized informative ACI features.

Further aspects, embodiments, and specific variations of the invention are defined by the further dependent claims.

BRIEF DESCRIPTION OF THE DRAWINGS

The invention will now be described in greater detail based on non-limiting examples of preferred embodiments and with reference to the appended drawings. On the drawings.

DETAILED DESCRIPTION OF THE INVENTION

Further terms and prerequisites useful for understanding the present invention will be explained when describing particular embodiments of the present invention in the following.

The objective of an embodiment of the present invention is to provide relevant features about a signal's self-resemblance with feasible demands to memory and computational load in a hearing aid context. These features are then passed on to subsequent systems for further analysis, inference and control decisions.

According to an embodiment, a hearing aid comprises an ACI kernel or ACI estimation means that calculates ACI features which are optimized in respect of how informative the features are for controlling signal processing in the hearing aid. The calculated ACI is divided into a number of band limited versions and a wide band version. In this way, a more detailed image of a signal's self-resemblance can be obtained, as the frequency bands responsible for a given self-similarity can be directly observed and compared.

Figure 1:
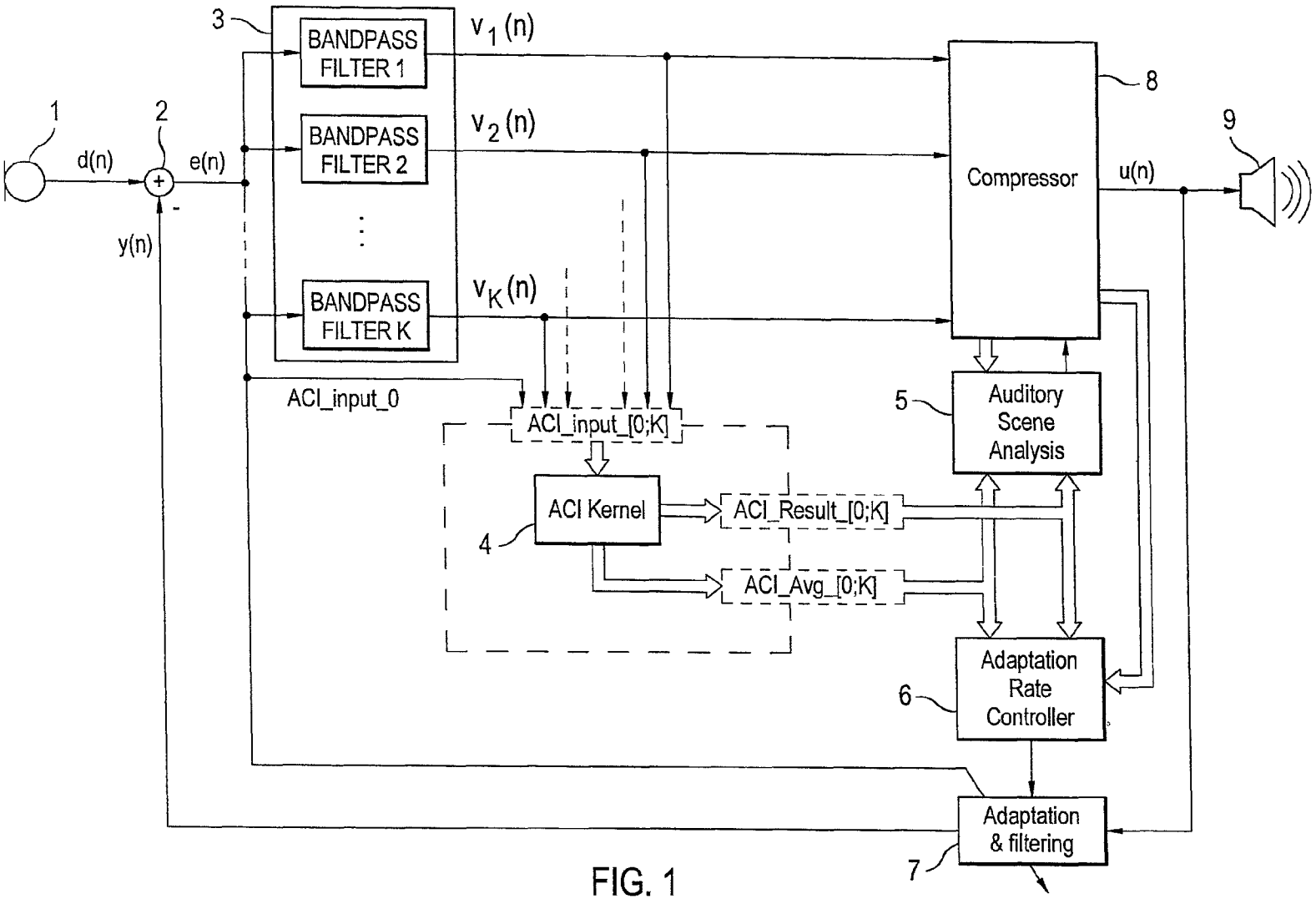
FIG. 1 is a block diagram showing a hearing aid according to an embodiment of the present invention.

An embodiment of such a hearing aid is illustrated in FIG. 1. FIG. 1 shows a block diagram of a hearing aid incorporating multiband audio compression and adaptive feedback cancellation, wherein the adaptation rate controller 6, the adaptive feedback cancellation block 7 and the audio compression block 8 individually modifies its operation through analysis of signals in the system supported by features provided by the ACI kernel 4. The hearing aid further comprises a band split or band pass filter bank 3 to split a wideband audio input signal into band limited audio signals for compensating a hearing impaired person's hearing loss across a number of frequency bands.

According to an embodiment, the first step to turn the autocorrelation function of equations 2 and 3 into a more relevant, continuously observable and practically applicable ACI is to replace the sum by a recursive update according to equation 5:

$$r_{mod}(n, j) = x(n) \cdot x(n-j) + \sum_{m=1}^{M} a_m \cdot r_{mod}(n-m, j) \tag{5}$$

where n indicates the newest collected sample, and the filter coefficients $a_m$ are predetermined to produce a low pass filter function. Other filter structures with a number of both feedback and feed forward coefficients could also be applied to generate equivalent results, according to another embodiment. The simplest case of the above equation is the leaky integrator. This results in an exponential forgetting factor of the processed input as given in equation 6:

$$r_{mod}(n,j)=x(n)\cdot(n-j)+a\cdot r_{mod}(n-1,j) \tag{6}$$

in which a is given a value between 0.5 and 1. In order to normalize the modified autocorrelation function to an index ranging from −1 to 1 the result should be divided by $r_{mod}(n, 0)$ as shown in equation 7:

$$\rho_{mod}(n, j) = \frac{r_{mod}(n, j)}{r_{mod}(n, 0)} \tag{7}$$

Since the autocorrelation function only changes in a moderate rate because of the average function described in equations 5 and 6, the normalization procedure of equation 7 can be done in an iterative manner with a negligible reduction in performance. In this way, a costly division can be replaced be a less costly multiplication as shown in equation 8:

$$\rho_{it}(n, j) = \begin{cases} \rho_{it}(n-1, j) + \Delta; & \text{if } \rho_{it}(n-1, j) \cdot r_{mod}(n, 0) < r_{mod}(n, j); \text{ else} \\ \rho_{it}(n-1, j) - \Delta \end{cases} \tag{8}$$

in which Δ is a small number just above zero. If the need of the subsequent system is limited to determine whether ρ is above a predetermined threshold $\rho_{threshold}$, the above equation can be simplified to equation 9:

$$\rho_{thr}(n, j) = \begin{cases} 1 & \text{if } \rho_{threshold} \cdot r_{mod}(n, 0) < r_{mod}(n, j); \text{ else} \\ 0 \end{cases} \tag{9}$$

According to an embodiment, a further optimization of the ACI features for relevancy is achieved by focusing the ACI on time lags or delays (j) of particular interest. At first, band limiting a signal in itself produces autocorrelation. This autocorrelation is however generally not of interest for subsequent systems utilizing the ACI. Therefore only time lags (j) with a small autocorrelation induced by the band limiting need to be calculated. Furthermore, if the ACI feature is passed to an adaptation rate controller for a feedback cancellation system as the one in the hearing aid of FIG. 1, the really interesting time lags are those that would indicate the amount of correlation between the feedback cancellation filter states and the microphone input. If the correlation is too strong at these or greater time lags, a risk of mal-adaptation is present. This situation should be handled by an adaptation rate controller as mentioned above and further described in co-pending PCT patent application filed on Apr. 2, 2007 "Hearing Aid, and a Method for Control of Adaptation Rate in Anti-Feedback Systems for Hearing Aids" filed by the same applicant and claiming priority of Danish patent application No. 2006 00467, and published as WO2007113282, the contents of which are incorporated herein by reference. As explained there, according to an embodiment, the ACI is generally only estimated for time lags corresponding to, and greater than, the delay through the hearing aid at the frequency band of interest.

Further optimization for relevancy contra algorithm complexity is achieved according to an embodiment by discarding the ACI calculation for time lags corresponding to wavelengths, i.e. frequencies, outside the frequency band of interest. This also enhances the frequency selectivity of the band divided ACI since a theoretical dominant sinusoid outside the frequency band of interest will be less able to affect the remaining autocorrelation bins.

According to embodiments of the present invention, the feature of interest for a subsequent system is the maximal normalized ACI within a frequency band. Thus, according to an embodiment, the following indexes are provided which illustrate the amount of self-resemblance within a set of frequency bands and the collective self-resemblance. In this manner, the feature vector is reduced to a few very informative ACI features.

$$ACI_{band_max}(n,k)=\max(\rho_{band\#k}(n,\vec{J}_k))\,|\,\vec{J}_k \in \text{selected time lags in band \#k} \tag{10}$$

$$ACI_{wb_max}(n)=\max(\rho_{wb}(n,\vec{J}_{wb}))\,|\,\vec{J}_{wb} \in \text{selected time lags for the wide band ACI} \tag{11}$$

According to an alternative embodiment to the one finding the most positive index of self-resemblance in an unified ACI-feature, there are provided indexes to find the most negative index of self-resemblance, i.e. finding the signals most self-opposite index as shown in equations 12 and 13:

$$ACI_{band_min}(n,k)=\min(\rho_{band\#k}(n,\vec{J}k))\,|\,\vec{J}_k \in \text{selected time lags in band \#k} \tag{12}$$

$$ACI_{wb_min}(n)=\min(\rho_{wb}(n,\vec{J}_{wb}))\,|\,\vec{J}_{wb} \in \text{selected time lags for the wide band ACI} \tag{13}$$

This alternative ACI feature can also be very interesting to subsequent systems. According to a particular embodiment, this feature is instrumental in distinguishing between string instruments and vocal sounds in an ASA (Auditory Scene Analysis) algorithm context. The detection of vocal sounds would induce a hearing aid gain-strategy optimized for speech perception and intelligibility while a string instrument sound would induce a gain-strategy optimized for listening comfort.

Other subsequent algorithms according to alternative embodiments treat negative self-resemblance identically with positive self-resemblance. In this case, the ACI information are unified into a single feature representing the largest absolute magnitude in self-resemblance as shown in equations 14 and 15:

$$ACI_{band_max\ abs}(n,k)=\max(|\rho_{band\#k}(n,\vec{J}_k)|)\,|\,\vec{J}_k \in \text{selected time lags in band \#k} \tag{14}$$

$$ACI_{wb_max\ abs}(n)=\max(|\rho_{wb}(n,\vec{J}_{wb})|)\,|\,\vec{J}_{wb} \in \text{selected time lags for the wide band ACI} \tag{15}$$

For simplicity, it is assumed hereinafter, but not limited to, that the largest absolute magnitude in self-resemblance is the feature of interest. A more computational effective manner to reach the feature vector is to do the normalization procedure after the strongest self-resemblance is found, avoiding needless repetition of the normalization procedure.

Having this in mind, the normalization by division turns into equation 16:

$$ACI(n) = \frac{\max(|r(n,\vec{J})|)}{r(n,0)}\ \Big|\ \vec{J} \in \text{selected time lags for the } ACI \tag{16}$$

the normalization by iterative division turns into equation 17:

$$ACI(n,k) = \begin{cases} ACI(n-1,k)+\Delta & \text{if } \exists\, j \in \vec{J};\ \psi_{test}(n) < |r(n,j)| \\ ACI(n-1,k)-\Delta & \text{else} \end{cases};\ \vec{J} \in \text{selected time lags for the } ACI,\ \psi_{test}(n) = ACI(n-1,k)\cdot r(n,0) \tag{17}$$

and the normalized threshold test turns into equation 18:

$$ACI(n,k) = \begin{cases} 1 & \text{if } \exists\, j \in \vec{J};\ \psi_{test}(n) < |\gamma(n,j)| \\ 0 & \text{else} \end{cases};\ \vec{J} \in \text{selected time lags for the } ACI,\ \psi_{test}(n) = \rho_{threshold}\cdot r(n,0) \tag{18}$$

In order to obtain the objective of providing relevant ACI features about a signals self-resemblance with feasible demands on memory and computational load, further measures are proposed according to embodiments of the present invention to reduce the computational demand and memory usage. With this objective in mind, embodiments are provided in which the stored time lagged signal is limited to the sign of the signal of interest. Storing the sign data instead of storing the full dynamics of the signal vastly reduces the memory demand of the hearing aid system. Moreover, the multiplications in calculating the correlation function are now reduced to sign operations which again vastly reduces the computational load on the hearing aid as it becomes apparent from equations 19:

$$\begin{aligned} sd(n) &= \text{sign}\,(x(n)) \\ r_{sd}(n,j) &= x(n)\cdot \text{sign}\,(x(n-j)) + a\cdot r_{sd}(n-1,j) \Leftrightarrow \\ r_{sd}(n,j) &= x(n)\cdot sd(n-j) + a\cdot r_{sd}(n-1,j) \Leftrightarrow \\ r_{sd}(n,j) &= a\cdot r_{sd}(n-1,j) + \begin{cases} x(n) & \text{if } sd(n-j)=1 \\ -x(n) & \text{if } sd(n-j)=-1 \end{cases} \end{aligned} \tag{19}$$

According to further embodiments, the normalized ACI features can then be obtained by utilization of equation 16, 17 or 18.

The present invention further shows that the sign operator performs satisfactory for estimating appropriate ACI features for the following reasons. Take a periodic signal p(n) and a completely random noise signal s(n). Adding the signals gives the example signal x(n) which is selected to be analysed for autocorrelation. If p(n) dominates s(n) it is unlikely that s(n) will cause a change in sign. However, if a sample from p(n) is small in amplitude, it is much more likely that s(n) will "randomize" the sign of x(n). If p(n) is zero the sign of x(n) is completely random. Through the p(n) to $\sqrt{E[s(n)^2]}$ ratio dependent probability function, the sign based autocorrelation feature on x(n) is able to perform surprisingly well. Further use of the sign operator leads to an algorithm which is normalized in nature as shown in equation 20:

$$sd(n) = \text{sign}(x(n)) \tag{20}$$

$$\rho_{ss}(n, j) = (1-a)\cdot \text{sign}(x(n))\cdot \text{sign}(x(n-j)) + a\cdot \rho_{ss}(n-1, j) \Leftrightarrow$$

$$\rho_{ss}(n, j) = (1-a)\cdot sd(n)\cdot sd(n-j) + a\cdot r_{sd}(n-1, j) \Leftrightarrow$$

$$\rho_{ss}(n, j) = a\cdot \rho_{ss}(n-1, j) + (1-a)\cdot \begin{cases} -1 & \text{if } (sd(n)=1)\oplus(sd(n-j)=1) \\ 1 & \text{else} \end{cases}$$

in which $\oplus$ denotes the XOR logical operator. Using the $\rho_{ss}$ feature leads to a very computational effective ACI, which has slightly different properties than the other features described. Since all samples are equally weighted, unlike the preceding embodiments in which samples with large amplitude dominate the samples with smaller amplitudes, this method provides a more stable index of autocorrelation, according to a further embodiment of the present invention.

Thus, a shift in amplitude no longer means that a certain set of samples dominates the index. The difference can be interpreted as the difference between the average autocorrelation and median autocorrelation, with the $\rho_{ss}$ based ACI being the median autocorrelation. The latter better depends on the subsequent system utilizing the ACI but in some embodiments both ACI features are used in the hearing aid system to perform as intended.

A set of summarized informative ACI features (also referred to as summarized features) combining the suggested methods above would enhance the analysis, inference and control decision of a wide range of subsequent hearing aid systems utilizing these features. Further embodiments of such hearing aids will be described in the following.

An Auditory Scene Analysis (ASA) system of a hearing aid according to an embodiment taking the described ACI features into account is able to decide whether the hearing aid should optimize its functionality for speech intelligibility, comfort, wind noise, chorus, music, environmental sounds like birds, occlusion, etc. According to a particular embodiment, the ACI features described above would help the ASA system discriminate between speech—indicated by a large most positive ACI feature and a small most negative ACI feature—, string instruments and sinusoids—indicated by a large most positive ACI feature and a comparably large most negative ACI feature—, and noise-like sounds—indicated by small ACI features. Through the long term development of the ACI features along with the band specific signal energy envelopes, the ASA system is able to categorize the general sound environments the hearing aid user are in. By obtaining an identification of the auditory scene, according to the invention, the skilled person will be capable of suggesting various ways of optimizing the signal processing in the hearing aid.

A Step Size Control (SSC) system for a feedback cancelling adaptive filter of a hearing aid according to an embodiment is able to more precisely determine the risk of maladaptation given a specific sound. If the ACI features indicate whistling or the presence of string instruments, the step size control system is adapted to reduce the step size or completely halt adaptation immediately. On the other hand, if the ACI features indicate noise-like sounds, the step size control system is adapted to encourage adaptation. According to further embodiments, the exact operation of a step size control algorithm also takes other factors into consideration, like the hearing aid gain and the effectiveness of its directional system, before calculating a rate of adaptation. This is described in detail in the co-pending patent application PCT/EP2006/061215, filed on Mar. 31, 2006, the content of which is hereby incorporated by reference.

An automatic loop gain estimation system of a hearing aid according to an embodiment used to dynamically find the whistling limit of the hearing aid is able to decide whether the hearing aid is close to the whistling limit or not. Even more so if the ACI features are communicated to the hearing aid in the opposite ear. This is described in detail in the already mentioned co-pending PCT patent application "Hearing Aid, and a Method for Control of Adaptation Rate in Anti-Feedback Systems for Hearing Aids"; filed on Apr. 2, 2007, and published as WO2007112777.

The embodiments described so far show that a carefully selected set of ACI features, as described in the present disclosure, are instrumental to improve the functionality of the hearing aid.

Figure 2:
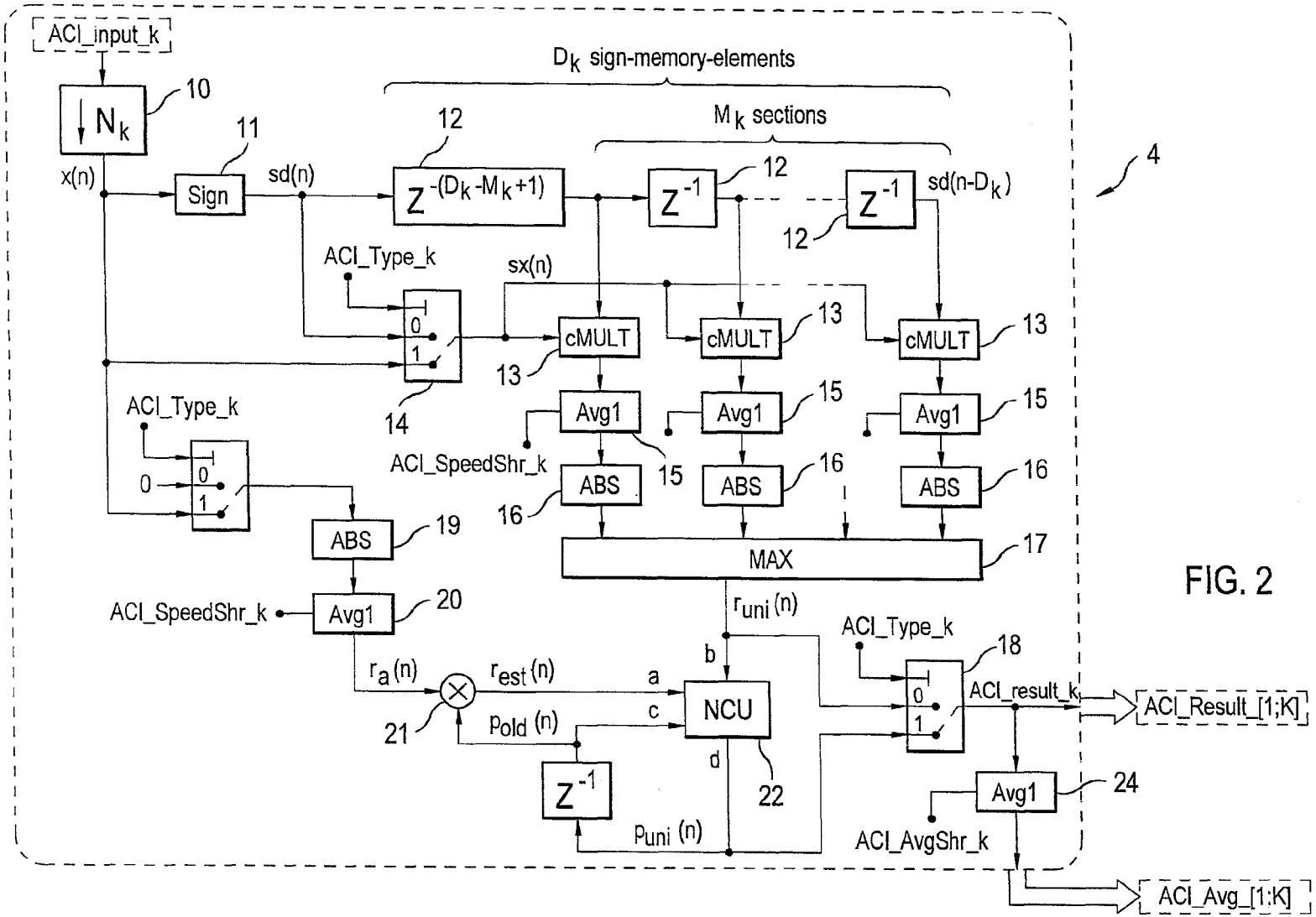
FIG. 2 is a block diagram showing the ACI kernel of the hearing aid of FIG. 1 according to an embodiment of the present invention.
Figure 3A:
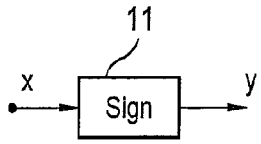
FIG. 3*a* is a block diagram showing a sign-extraction sub-block utilized in the ACI kernel of FIG. 2.
Figure 3B:
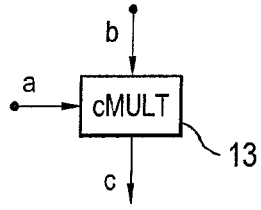
FIG. 3*b* is block diagram showing a sub-block cMULT utilized in the ACI kernel of FIG. 2.
Figure 3C:
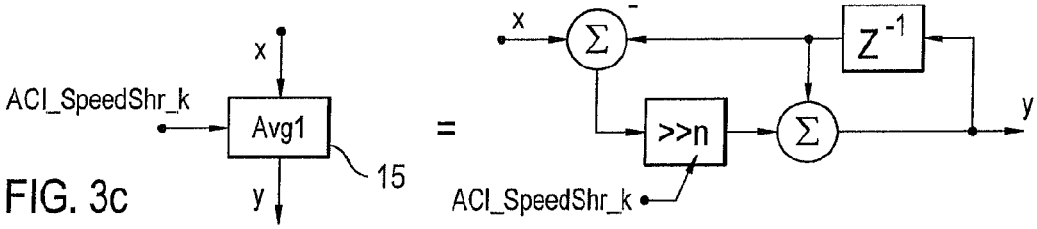
FIG. 3*c* is block diagram showing a sub-block Avg1 utilized in the ACI kernel of FIG. 2.
Figure 3D:
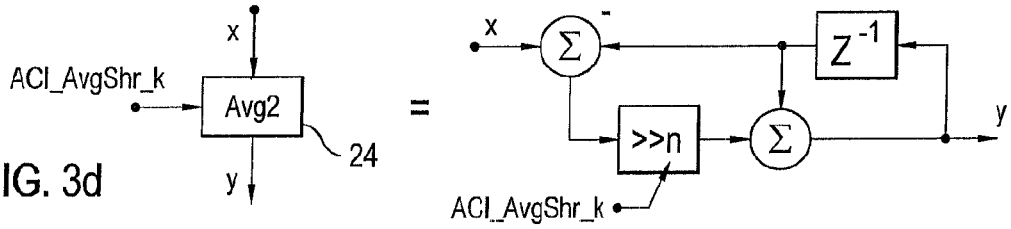
FIG. 3*d* is block diagram showing a sub-block Avg 2 utilized in the ACI kernel of FIG. 2.
Figure 3E:
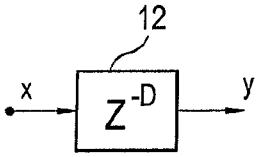
FIG. 3*e* is block diagram showing a sign-memory block utilized in the ACI kernel of FIG. 2.

In the following, an implementation of a hearing aid providing relevant summarized ACI features about a signals self-resemblance with feasible demands on memory and computational load according to embodiments of the present invention will be described in more detail with reference to the FIGS. 1-4. FIG. 1 shows a block diagram of a hearing aid implementing an ACI kernel 4 producing summarized ACI features ACI_Result_[0; K] and ACI_Avg_[0; K]. FIG. 4 shows a flow diagram of operations 410 to 480 for controlling the hearing aid by estimating ACI features according to the present invention. In FIG. 2 a detailed block diagram of the ACI kernel 4 according to an embodiment of the present invention is depicted. FIGS. 3*a*-3*g* depict more detailed block diagrams and functional descriptions of the sub-blocks present in the ACI kernel according to FIG. 2.

The hearing aid in FIG. 1 includes a microphone 1 for receiving an audio input signal d(n) (operation 410), a summation node (also referred to as subtraction node since signal y(n) has a negative sign) 2 for compensating acoustic feedback originating from the receiver 9 leaking back to the microphone 1. The subtraction node subtracts a feedback cancellation signal y(n) from the audio input signal d(n) thereby generating a bandpass filter input signal e(n). A bandpass filter bank 3 comprises k bandpass filters splitting the feedback compensated bandpass filter input signal e(n) into a number of band limited audio signals $v_k(n)$ ($k \in [1; K]$). A compressor 8 produces a compressor output signal u(n) by applying a gain on each of the band limited audio signals $v_k(n)$. A receiver 9 converts the processor output signal u(n) into output sound. Moreover, an adaptive feedback cancellation filter in the adaptive feedback cancellation block 7 adaptively derives, based on the bandpass filter input signal e(n), respective filter coefficients and an adaptation rate provided by adaptation rate controller 6, the feedback cancellation signal y(n) from the processor output signal u(n).

The band limited signals $v_k(n)$ and the wide band signal e(n) are then gathered together as input to the ACI kernel 4. The ACI kernel 4 outputs a set of estimated features for each band limited signal and the wide band signal (operation 420). These are delivered to the subsequent systems of the hearing aid, like the auditory scene analysis block 5 and the adaptation rate controller 6. The band limited signals $v_k(n)$ are furthermore input to the compressor 8 which at first calculates the signal envelopes based on these input signals.

From the features delivered by the ACI kernel 4 and signal envelope features delivered from the compressor 8 the auditory scene analysis block 5 is able to categorize the sound environment in a fuzzy manner. This fuzzy categorization is then fed back to the compressor 8, which is now able to select a gain strategy for the hearing aid user according to the hearing aid users hearing loss, the input sound level envelope and the sound environment category. Based on these summarized features the compressor 8 calculates and applies a gain on each individual band limited audio signals $v_k(n)$ and add them together to a single compressor output signal u(n).

The calculated set of gain parameters is then fed to the adaptation rate controller 6 along with the ACI features provided by the ACI kernel. Based on these features the adaptation rate controller 6 is able to calculate an optimized adaptation rate for the adaptation mechanism of the adaptation and filtering block 7 and, according to a particular embodiment, for adjusting the filter coefficients for the adaptive feedback cancellation filter in the adaptation and filtering block 7. Furthermore, the adaptation and filtering block 7 is fed with the compressor output u(n) in order to simulate and adapt to the feedback path thus generating the feedback estimate (also called feedback cancellation signal) y(n). Finally, as already mentioned, the compressor output u(n) is fed to the receiver unit 9 converting the digital signal u(n) into audible sound waves.

Figure 3F:
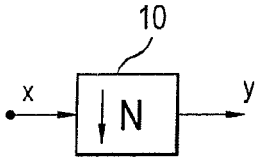
FIG. 3*f* is block diagram showing a down-sampling block utilized in the ACI kernel of FIG. 2.
Figure 4:
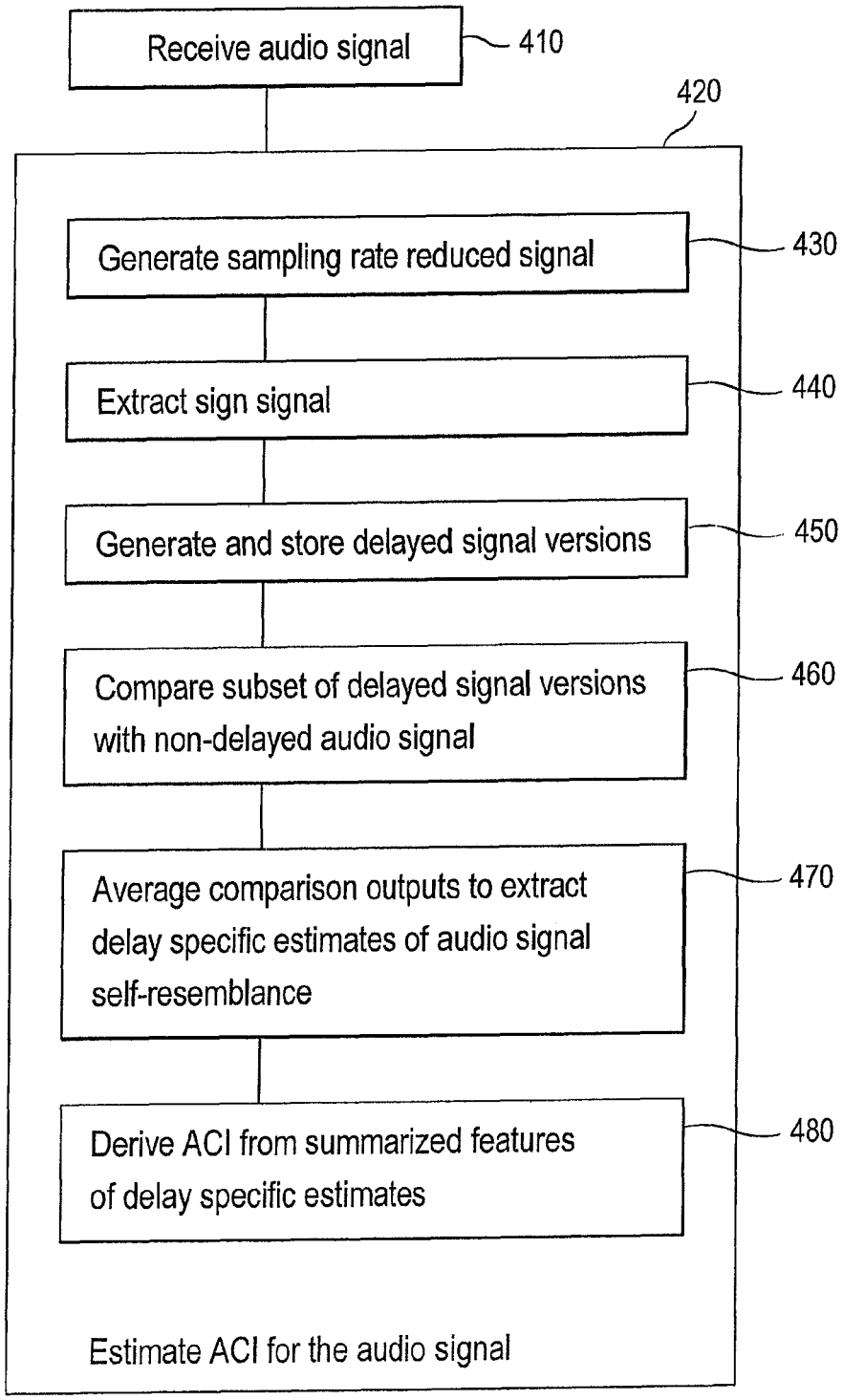
FIG. 4 is a flow diagram of a method according to an embodiment of the present invention.

The ACI kernel 4 as depicted in FIG. 2 includes a down-sampling block 10 which reduces the calculation and memory load by the factor $N_k$. as illustrated in FIG. 3*f* by skipping every N'th sample of the ACI_input_[0; K] signals (operation 430). Succeeding the down sampling block 10 is a sign extraction block 11 as illustrated in FIG. 3*a* extracting the sign signal sd(n) (operation 440). The sign extraction block again feeds the sign signal sd(n) to a sign-memory block 12 as illustrated in FIG. 3*e*. The sign-memory block 12 is also called memory and delay means and produces delayed versions of the sign signal $sd(n-D_k)$ by applying a time lag or delay by D samples on the sign signal $sd_k(n)$ (operation 450).

Subsets of the delayed versions of the sign signal are then compared with a version of the non-delayed audio input signal by comparison units (operation 460). According to the embodiment as depicted in FIG. 2, each comparison unit is implemented by a cMULT block 13 as illustrated in FIG. 3*b*. The outputs of the last $M_k$ sign memory sections for each signal band k are each fed to a cMULT block 13 as illustrated in FIG. 3*b*. Each cMULT block 13 chooses its output based on the delayed $sd_k(n)$ sign signal. If said sign signal is positive the cMULT block 13 chooses $sx_k(n)$ as its output and vice versa, i.e. if said sign signal is negative, the cMULT block chooses—$sx_k(n)$ as output. The $sx_k(n)$ signal can be chosen to be either the $sd_k(n)$ signal or the original $x_k(n)$ as fulfilled by the multiplexer 14 based on the kernel parameter input ACI_type_k.

The outputs of the comparison units are then averaged to extract delay specific estimates of the signals self-resemblance (operation 470). According to the embodiment as depicted in FIG. 2, the output of each cMULT block 13 is low pass filtered by the Avg1 block 15 as illustrated in FIG. 3*c*. The averaging time constant of the Avg1 blocks 15 is determined by the kernel parameter input ACl_SpeedShr_k.

Subsequently, in operation 480, the summarized features are determined from the delay specific estimates output by the Avg1 blocks 15. According to the embodiment as depicted in FIG. 2, the low pass filtered outputs of the cMULT blocks are fed to ABS blocks 16 returning the absolute magnitude of its input. All of these signals from the ABS blocks 16 is then passed to a MAX block 17 finding the strongest available self-resemblance or self-opposite $r_{uni}(n)$. If the kernel parameter input ACI_type_k is set to zero, the unified ACI_Result_k feature is directly passed from the MAX 17 block's output $r_{uni}(n)$, otherwise, $r_{uni}(n)$ undergoes a normalization procedure by iterative division before passed to output by the multiplexer 18 outputting the selected autocorrelation index.

According to an embodiment, the largest theoretically obtainable estimate of signal self-resemblance by the Avg1 blocks 15 in operation 470 is found in two steps. Firstly, the down-sampled signal x(n) is passed to and rectified by the ABS block 19. Secondly, the rectified x(n) is low pass filtered 20 by the same filter functionality as was performed by the above-mentioned low pass filters 15.

Figure 3G:
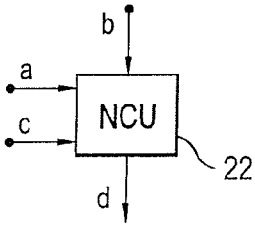
FIG. 3*g* is block diagram showing normalization comparison unit utilized in the ACI kernel of FIG. 2.

With the largest theoretically obtainable estimate of signal self-resemblance $r_0(n)$, the last estimate on the normalized ACI feature $p_{old}(n)$ is multiplied with $r_0(n)$ by the multiplication block 21 thus generating an estimate $r_{est}(n)$ on the signal $r_{uni}(n)$. If the signal $r_{est}(n)$ is smaller than the actual signal $r_{uni}(n)$ the normalization comparison unit NCU 22 decides to increase the normalized ACI feature by A by adding Δ to the signal $p_{old}(n)$ generating the output $P_{uni}(n)$. Vice versa, if the signal $r_{est}(n)$ is larger than or equal to the actual signal $r_{uni}(n)$ the normalization comparison unit 22 decides to decrease the normalized ACI feature by Δ by subtracting A from the signal $p_{old}(n)$. FIG. 3*g* further illustrates the functionality of the normalization comparison unit 22.

According to another particular embodiment, the multiplexer 18 passes the chosen type of the ACI_result to the secondary low pass filter Avg2 24 which is illustrated in FIG. 3*d*. Said secondary low pass filter generates a secondary ACI feature passed to the ACI_Avg_[0; K] vector. This secondary feature vector ACI_Result_[0; K] contains information on the development trend of the primary feature which can then be utilized by the further signal processing units in the hearing aid as well.

Further exemplary embodiments of the present invention may be summarized as follows:

A hearing aid comprises a signal path capable of receiving a digitized audio input signal, means for reducing the sampling-rate of said signal as suitable, means for extracting the sign of said reduced sampling rate signal, means for remembering and delaying said sign signal, means for comparing a subset of the delayed versions of said sign signal with the audio input signal without delay, and averaging means on each comparing units output to extract a time lag specific estimate of the signals self-resemblance.

The hearing aid further comprises means for obtaining summarized features on a signals self-resemblance from the set of time lag specific estimates of the signals self-resemblance. Said summarized features are determined by finding the value of either the most positive, the most negative or the largest in amplitude time lag specific estimate of signal self-resemblance.

Each of the of comparison units generates a sign output based on the sign of the audio input signal and the delayed sign signals.

Each of the of comparison units generates an output with the amplitude of the audio input signal and a sign based on comparing the sign of the audio input signal with the delayed sign signals.

The hearing aid further comprises means for normalizing said summarized features by division with the largest theoretically obtainable estimate of signal self-resemblance.

The normalization procedure is obtained by iterative division, and each division iteration occurs concurrently with updates on the calculated estimates of signal self-resemblance.

The hearing aid further comprises means for evaluating the excess of one or more normalized thresholds, wherein the excess is determined by comparing the magnitude of a summarized un-normalised self-resemblance feature with the largest theoretically obtainable estimate of signal self-resemblance multiplied by the normalized threshold value in question.

The averaging means is implemented by an auto regressive low pass filter.

The hearing aid further comprises a long term average on the summarized self-resemblance features.

The hearing aid further comprises means for obtaining summarized features on a signals self-resemblance from the set of time lag specific estimates of the signals self-resemblance. Said summarized features are determined by finding the index number of either the most positive, the most negative or the largest in amplitude time lag specific estimate of self-resemblance.

In the hearing aid, a number of audio input signals are evaluated for self-resemblance, said audio input signals being derived from a number of band pass filters and direct passing of a wide band audio input signal.

A method for extracting auto correlation related features in a hearing aid system comprises the steps of receiving a digitized audio input signal, reducing the sampling-rate of said signal as suitable, extracting the sign of said reduced sampling rate signal, remembering and delaying said sign signal, comparing a subset of the delayed versions of said sign signal with the audio input signal without delay, and averaging the comparison outputs to extract time lag specific estimates of the signals self-resemblance.

The method further comprises steps for obtaining summarized features on a signals self-resemblance from the set of time lag specific estimates of the signals self-resemblance. Said summarized features are determined by finding the value of either the most positive, the most negative or the largest in amplitude, time lag specific estimate of signal self-resemblance.

The step of comparison generates sign outputs based on the sign of the audio input signal and the delayed sign signals.

The step of comparison generates outputs with the amplitude of the audio input signal and a sign based on comparing the sign of the audio input signal with the delayed sign signals.

The method further comprises a step for normalizing said summarized features by division with the largest theoretically obtainable estimate of signal self-resemblance.

The normalization procedure is obtained by iterative division, and each division iteration occurs concurrently with updates on the calculated estimates of signal self-resemblance.

The method further comprises a step for evaluating the excess of one or more normalized thresholds, wherein the excess is determined by comparing the magnitude of a summarized un-normalised self-resemblance feature with the largest theoretically obtainable estimate of signal self-resemblance multiplied by the normalized threshold value in question.

The averaging step is performed by an auto regressive low pass filter.

The method further comprises a step for long term averaging on the summarized self-resemblance features.

The method further comprises a step for obtaining summarized features on a signals self-resemblance from the set of time lag specific estimates of the signals self-resemblance. Said summarized features are determined by finding the index number of either the most positive, the most negative or the largest in amplitude, time lag specific estimate of self-resemblance.

In the method, a number of audio input signals are evaluated for self-resemblance and the audio input signals are derived from a number of band pass filters and direct passing of a wide band audio input signal.

A method for controlling the signal processing in a hearing aid comprises the steps of estimating the autocorrelation index for one or more signals in the hearing aid and controlling the signal processing in the hearing aid based on this estimate.

A hearing aid comprises signal processing means, means for estimating the autocorrelation index for one or more signals in the hearing aid and control means for control of the signal processing, wherein the control means utilize the estimated autocorrelation index.

All appropriate combinations of features described above are to be considered as belonging to the invention, even if they have not been explicitly described in their combination.

According to embodiments of the present invention, hearing aids described herein may be implemented on signal processing devices suitable for the same, such as, e.g., digital signal processors, analogue/digital signal processing systems including field programmable gate arrays (FPGA), standard processors, or application specific signal processors (ASSP or ASIC). Obviously, it is preferred that the whole system is implemented in a single digital component even though some parts could be implemented in other ways—all known to the skilled person.

Hearing aids, methods and devices according to embodiments of the present invention may be implemented in any suitable digital signal processing system. The hearing aids, methods and devices may also be used by, e.g., the audiologist in a fitting session. Methods according to the present invention may also be implemented in a computer program containing executable program code executing methods according to embodiments described herein. If a client-server-environment is used, an embodiment of the present invention comprises a remote server computer that embodies a system according to the present invention and hosts the computer program executing methods according to the present invention. According to another embodiment, a computer program product like a computer readable storage medium, for example, a floppy disk, a memory stick, a CD-ROM, a DVD, a flash memory, or any other suitable storage medium, is provided for storing the computer program according to the present invention.

According to a further embodiment, the program code may be stored in a memory of a digital hearing device or a computer memory and executed by the hearing aid device itself or a processing unit like a CPU thereof or by any other suitable processor or a computer executing a method according to the described embodiments.

Having described and illustrated the principles of the present invention in embodiments thereof, it should be apparent to those skilled in the art that the present invention may be modified in arrangement and detail without departing from such principles. Changes and modifications within the scope of the present invention may be made without departing from the spirit thereof, and the present invention includes all such changes and modifications.

I claim:

1. A hearing aid, comprising:

a signal path for receiving at least one wideband audio input signal;

autocorrelation index (ACI) estimating means, comprising:

down-sampling means for producing a sampling-rate reduced signal of said audio input signal;

sign extraction means for extracting a sign signal of said sampling-rate reduced signal;

memory and delay means for producing and storing delayed versions of said sign signal;

comparison means for producing a subset of the delayed versions of said sign signal and comparing said subset with a version of the audio input signal;

averaging means for averaging outputs of the comparison means to extract delay specific estimates of the signals self-resemblance of the delayed versions of said sign signal and the audio input signal; and autocorrelation index estimating means for obtaining an estimated autocorrelation index by determining summarized features from the delay specific estimates of the signals self-resemblance of said signals, wherein said summarized features define summarized informative ACI features.

2. The hearing aid according to claim 1 comprising:

a bandpass filter bank for splitting the wideband audio input signal into band limited audio signals;

the autocorrelation index estimating means being adapted for estimating at least one autocorrelation index by calculating an autocorrelation matrix for said band limited audio signals and an autocorrelation vector for said wideband audio input signal.

3. The hearing aid according to claim 1, wherein said summarized features are determined by finding the value of either the most positive, the most negative or the largest in amplitude, delay specific estimate of the signals self-resemblance.

4. The hearing aid according to claim 1, wherein the subset of the delayed versions of said sign signals comprises only versions having a delay equal to or greater than the delay through the hearing aid at the frequency band of the respective band limited audio signal.

5. The hearing aid according to claim 1, wherein the comparison means comprises a set of comparison units each generating a sign comparing output signal based on the sign of the non-delayed audio input signal and the respective delayed sign signals, and preferably having an amplitude of the non-delayed audio input signal and a sign based on comparing the sign of the non-delayed audio input signal with the delayed sign signals.

6. The hearing aid according to claim 1, wherein the autocorrelation index estimating means comprises at least one of normalizing means for normalizing said summarized features by division with the largest theoretically obtainable estimate of said signals self-resemblance, said normalization means preferable being adapted to normalize said summarized features by iterative division, each division iteration occurring concurrently with updates on the estimates of said signals self-resemblance;

means for determining the excess of one or more normalized thresholds by comparing the magnitude of one of said summarized features of with the largest obtainable estimate of the signals self-resemblance multiplied with the normalized threshold value in question;

means for generating a long term average on the summarized features; and means for obtaining summarized features on a signals self-resemblance from the set of delay specific estimates of the signals self-resemblance by finding the index number of either the most positive, the most negative or the largest in amplitude, delay specific estimate of the signals self-resemblance.

7. The hearing aid according to claim 1, wherein the averaging means is an auto regressive low pass filter.

8. The hearing aid according to claim 1, further comprising:

a microphone for converting sound of a sound environment of the hearing aid into said audio input signal;

a subtraction node for subtracting a feedback cancellation signal from the audio input signal thereby generating a bandpass filter input signal, a bandpass filter for splitting the bandpass filter input signal into band limited audio signals;

a compressor for producing a compressor output signal by applying a gain on each of the band limited audio signals;

a receiver for converting the processor output signal into output sound;

an adaptive feedback cancellation filter for adaptively deriving a feedback cancellation signal from the processor output signal.

9. The hearing aid according to claim 8, further comprising:

auditory scene analysis means for classifying the sound environment category based on at least one of the estimated autocorrelation indexes and signal envelope features input from the processor; said compressor being adapted to derive the gain from the hearing aid users hearing loss, the input sound envelope of the band limited audio signals and the sound environment category input from the auditory scene analysis means.

10. The hearing aid according to claim 8, further comprising:

an adaptation rate controller for adjusting an adaptation rate of the adaptive feedback cancellation filter based on at least one of the estimated autocorrelation indexes and the gain.

11. A method for controlling signal processing in a hearing aid comprising:

receiving at least one wideband audio input signal;

estimating an autocorrelation index for said audio input signal, comprising:

generating a sampling-rate reduced signal of the audio input signal;

extracting a sign signal of said sampling rate reduced signal;

generating and storing delayed versions of said sign signal;

producing a subset of the delayed versions of said sign signal;

comparing said subset with a version of the audio input signal;

averaging outputs of the comparing step to extract delay specific estimates of the signals self-resemblance of the delayed versions of said sign signal and the audio input signal; and deriving a version of the estimated autocorrelation index by determining summarized features from the delay specific estimates of the signals self-resemblance of said signals, wherein said summarized features define summarized informative ACI features.

12. The method according to claim 11 comprising:

splitting the wideband and in input signal into hand limited and in signals; and estimating at least one autocorrelation index by calculating at least one of an autocorrelation matrix for at least one set of said band limited audio signals and an autocorrelation vector for said wideband audio input signal.

13. The method according to claim 11, wherein said summarized features are determined by finding the value of either the most positive, the most negative or the largest in amplitude, delay specific estimate of the signals self-resemblance.

14. The method according to claim 11, wherein the subset of the delayed versions of said sign signals comprises only versions having a delay equal to or greater than the delay through the hearing aid at the frequency band of the respective band limited audio signal.

15. The method according to claim 11, wherein the comparing step further comprises generating a set of sign comparing output signals based on the sign of the non-delayed audio input signal and the respective delayed sign signals, and preferably having an amplitude of the non-delayed audio input signal and a sign based on comparing the sign of the non-delayed audio input signal with the delayed sign signals.

16. The method according to claim 11, wherein the step of estimating the autocorrelation index further comprises at least one of normalizing said summarized features by division with the largest theoretically obtainable estimate of said signals self-resemblance, preferably by iterative division, each division iteration occurring concurrently with updates on the estimates of said signals self-resemblance;

determining the excess of one or more normalized thresholds by comparing the magnitude of one of said summarized features with the largest obtainable estimate of the signals self-resemblance multiplied with the normalized threshold value in question;

generating a long term average on the summarized features; and obtaining summarized features on a signals self-resemblance from the set of delay specific estimates of the signals self-resemblance by finding the index number of either the most positive, the most negative or the largest in amplitude, delay specific estimate of the signals self-resemblance.

17. The method according to claim 11, further comprising:

converting sound of a sound environment of a hearing aid into said audio input signal;

subtracting a feedback cancellation signal from the audio input signal thereby generating a bandpass filter input signal, wherein the bandpass filter input signal is split into said band limited audio signals;

generating a compressed output signal by applying a gain on each of the band limited audio signals;

converting the processed output signal into output sound; and adaptively deriving the feedback cancellation signal from the processor output signal.

18. The method according to claim 17, further comprising:

classifying the sound environment category based on at least one of the estimated autocorrelation indexes and signal envelope features input from the processor; and deriving the gain from the hearing aid users hearing loss, the input sound envelope of the band limited audio signals and the sound environment category.

19. The method according to claim 17, further comprising:

adjusting an adaptation rate for adaptively deriving the feedback cancellation signal based on at least one of the estimated autocorrelation indexes and the gain.

20. A computer program product comprising non-transitory computer-readable medium storing program code for performing, when run on a computer, a method for controlling signal processing in a hearing aid comprising:

receiving at least one wideband audio input signal;

estimating an autocorrelation index for said audio input signal, by way of generating a sampling-rate reduced signal of the audio input signal; extracting a sign signal of said sampling rate reduced signal; generating and storing delayed versions of said sign signal; producing a subset of the delayed versions of said sign signal; comparing said subset with a version of the audio input signal; averaging outputs of the comparing step to extract delay specific estimates of the signals self-resemblance of the delayed versions of said sign signal and the audio input signal; and deriving a version of the estimated autocorrelation index by determining summarized features from the delay specific estimates of the signals self-resemblance of said signals, wherein said summarized features define summarized informative ACI features.

* * * * *